US010704219B2

(12) United States Patent
Schlatter et al.

(10) Patent No.: US 10,704,219 B2
(45) Date of Patent: Jul. 7, 2020

(54) METHOD OF POWER MANAGEMENT IN PILE FOUNDATION HAVING A BASE MACHINE AND AN ATTACHMENT INSTALLED THEREAT

(71) Applicant: Liebherr-Werk Nenzing GmbH, Nenzing (AT)

(72) Inventors: Nicola Schlatter, Nenzing (AT); Patrick Jussel, Bludenz (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 0 days.

(21) Appl. No.: 16/286,268

(22) Filed: Feb. 26, 2019

(65) Prior Publication Data

US 2019/0264413 A1 Aug. 29, 2019

(30) Foreign Application Priority Data

Feb. 26, 2018 (DE) ..... 10 2018 104 331

(51) Int. Cl.

| | |
|---|---|
| ***E02D 13/00*** | (2006.01) |
| ***E02D 7/18*** | (2006.01) |
| ***E02D 7/26*** | (2006.01) |
| ***E21B 7/20*** | (2006.01) |
| ***E02D 7/28*** | (2006.01) |

(52) U.S. Cl.

CPC ..... *E02D 13/00* (2013.01); *E02D 7/18* (2013.01); *E02D 7/26* (2013.01); *E02D 7/28* (2013.01); *E21B 7/20* (2013.01); *E02D 2250/00* (2013.01); *E02D 2600/00* (2013.01)

(58) Field of Classification Search

CPC .. E02D 13/00; E02D 7/18; E02D 7/26; E02D 2250/00; E02D 2600/00

See application file for complete search history.

(56) References Cited

U.S. PATENT DOCUMENTS

| | | | | |
|---|---|---|---|---|
| 5,653,295 | A * | 8/1997 | Juvonen | B25D 9/145 173/207 |
| 6,666,022 | B1 * | 12/2003 | Yoshimatsu | B60K 6/46 60/413 |
| 7,156,188 | B2 * | 1/2007 | Bermingham | E02D 7/02 173/128 |
| 8,606,444 | B2 * | 12/2013 | Andris | B60L 1/00 701/22 |
| 8,853,883 | B2 * | 10/2014 | Andris | B60K 6/46 307/9.1 |
| 8,972,121 | B2 * | 3/2015 | Kurikuma | E02F 9/207 701/50 |
| 9,187,295 | B2 * | 11/2015 | Schneider | B66C 15/065 |
| 9,284,718 | B2 * | 3/2016 | Hijikata | E02F 9/2091 |
| 9,290,908 | B2 * | 3/2016 | Hiroki | E02F 9/123 |

(Continued)

FOREIGN PATENT DOCUMENTS

DE 102015105908 A1 10/2016

*Primary Examiner* — Benjamin F Fiorello
(74) *Attorney, Agent, or Firm* — McCoy Russell LLP

(57) ABSTRACT

The present invention relates to a method of power management during pile foundation having a base machine for excavating a borehole and an attachment installed at the base machine for a simultaneous introduction of a casing into the ground, wherein the energy supply for the attachment is at least partially provided by the base machine and a control of the base machine dynamically regulates the energy flow from the base machine to the attachment.

20 Claims, 3 Drawing Sheets

(56) References Cited

U.S. PATENT DOCUMENTS

| | | | | |
|---|---|---|---|---|
| 9,394,671 | B2 * | 7/2016 | Hirozawa | E02F 9/2217 |
| 9,878,885 | B2 * | 1/2018 | Scheider | B66C 13/18 |
| 10,046,953 | B2 * | 8/2018 | Schneider | B66C 13/063 |
| 2009/0219656 | A1 * | 9/2009 | Lindsey | H02H 3/16<br>361/42 |
| 2009/0251154 | A1 * | 10/2009 | Lindsey | G01R 31/1227<br>324/551 |
| 2013/0169232 | A1 * | 7/2013 | Middleton | H02J 7/0021<br>320/134 |
| 2016/0305234 | A1 | 10/2016 | Korherr et al. | |

* cited by examiner

METHOD OF POWER MANAGEMENT IN PILE FOUNDATION HAVING A BASE MACHINE AND AN ATTACHMENT INSTALLED THEREAT

CROSS REFERENCE TO RELATED APPLICATIONS

The present application claims priority to German Application No. 10 2018 104 331.7 entitled "METHOD OF POWER MANAGEMENT IN PILE FOUNDATION HAVING A BASE MACHINE AND AN ATTACHMENT INSTALLED THEREAT," filed Feb. 26, 2018. The entire contents of the above-listed application are hereby incorporated by reference in their entirety for all purposes.

TECHNICAL FIELD

The invention relates to a method of power management during pile foundation having a base machine for excavating a borehole and an attachment installed at the base machine for a simultaneous introduction of a casing into the ground, wherein the energy supply for the attachment is at least partially provided by the base machine.

BACKGROUND AND SUMMARY

During drilling with a hammer grab using an attachment in the form of a casing oscillator/casing rotator, two units that are per se independent work together in the preparation of a pile. The base machine in the form of a cable excavator comprises a hammer grab for excavating a hole. A casing oscillator/casing rotator likewise fastened to the cable excavator serves the clamping of the casing that is to be introduced into the ground by uniform rotational movements synchronously to the excavation. The required energy for the casing oscillator is typically provided by the base machine.

The operator of the cable excavator/drilling rig or of the casing oscillator/casing rotator, for example, sets the energy flow to the casing oscillator/casing rotator via a regulator. The disadvantage of this method is that the energy flow is so-to-say static and can only be changed sporadically. It can occur here, in dependence on the workstep or on the work cycle, that the casing oscillator is provided either with too much or too little energy for the respective work, whereby not only the total energy consumption is unnecessarily increased, but likewise delays in the work routine have to be accepted.

A solution is therefore sought that is able to overcome the disadvantages explained above.

This object is achieved by a method of power management during pile foundation having a base machine for excavating a borehole and an attachment installed at the base machine for a simultaneous introduction of a casing into the ground, wherein an energy supply for the attachment is at least partially provided by the base machine. Starting from the method of the category, it is proposed in accordance with the invention that a control of the base machine dynamically regulates the energy flow from the base machine to the attachment. The base machine can, for example, be a cable excavator that is equipped with a corresponding hammer grab drill for excavating a borehole or with a drilling rig such as a Kelly drill. The attachment is, for example, a casing oscillator or a casing rotator for introducing a casing into the ground.

In accordance with the invention, the control of the base machine should dynamically regulate the distribution of the energy between the attachment and the base machine in order thereby to optimize the capacity and effectiveness of the two machines. It is primarily a question of hydraulic or pneumatic energy that is provided to the attachment by the base machine. The method is, however, not restricted to a specific type of energy and could equally be used for the energy management of electrical energy.

It is sensible if the regulation of the energy flow takes place while taking account of the current power requirement of the base machine and/or of the attachment. The process routine is meaningfully known to the control or the control has knowledge of future worksteps of the base machine or of the attachment. In cyclic processes, this knowledge can also be learnt from past cycles. If, for instance, one of the two consumers is always stretched to its limits energetically in the same part cycle and if simultaneously the other consumer does not require the total energy, a dynamic adaptation can be learnt. A dynamic regulation of the energy flow can thereby take place on the basis of this information on subsequent worksteps. Specifically, the total energy expenditure for the preparation of the pile is composed of the power requirement of the base machine for the excavation of the borehole and the power requirement of the attachment for introducing the casing. The respective cyclic worksteps performed on the units are characterized by a variable power requirement. It is accordingly sensible to supply the attachment with less energy during the carrying out of worksteps with less energy expenditure to be able to instead utilize the surplus energy in the base machine. If instead a process with a high energy requirement takes place in the attachment and if the base machine requires comparatively little power, it is sensible to maximize the energy flow to the attachment. Individual worksteps can thereby be directly carried out faster, which can optimize the total process time. The total energy requirement during the pile foundation process can also hereby be optimized since the unnecessary provision of surplus energy to the base machine or to the attachment is prevented or at least reduced.

It is conceivable for the dynamic regulation to limit the energy flow to the attachment or to stop it completely under certain circumstances. A limitation can take place stepwise, for example. A continuous limitation is, however, also conceivable to enable an adjustment of the energy flow that is as fine as possible.

As claimed, the control of the energy flow takes place by a control of the base machine. It is, however, likewise conceivable to outsource the process performance to an external control in part, for example to the control of the attachment. There is meaningfully a communication interface between the base machine and the attachment to be able to exchange information relevant to the process for the dynamic regulation of the energy flow between the machines.

There is likewise the possibility of exchanging a demand for a power reduction or a power increase between the machines over the communication interface. It is, for example, conceivable that the base machine or the control of the base machine requests the attachment to reduce its energy consumption over the communication interface to thereby ensure a higher power proportion for the base machine. Conversely, the attachment could also request an increase of the energy flow to the attachment from the base machine over the communication interface.

A corresponding request for a power reduction to the attachment can also include an instruction on and a specification of worksteps of the attachment to be carried out. It is conceivable in this context that the base machine specifies worksteps to be carried out to the attachment or recommends one or more worksteps. Such a recommendation is meaningfully based on the base machine's own power requirement. If it requires a comparatively large amount of power, the specification or recommendation includes energy-saving worksteps; conversely, the carrying out of high-energy worksteps is recommended/specified if surplus energy is currently available on the part of the base machine.

The process time of individual worksteps can be directly influenced or controlled by means of the dynamic regulation of the energy flow. This relates to worksteps both of the attachment and of the base machine. The rotational movement of the attachment can, for example, be specifically accelerated by the provision of additional energy. Conversely, a power reduction produces a delay or a slowing down of the respective worksteps.

It is of particular importance for the pile foundation and in particular for an optimum energy expenditure during the pile foundation that the casing process is synchronized with the simultaneous excavation of the borehole. If, for example, the excavation of the casing takes place in advance, there is the risk of a crashing of the casing, which can cause material damage and costs. If, however, the casing is too far in advance, the jacket friction on the inner side becomes too large, which can cause higher energy costs. The progress of both processes should accordingly be kept approximately the same or the casing depth should be slightly in advance of the excavation depth with a constant interval.

This relationship makes a monitoring of the different between the depth of the earth excavation and the casing depth sensible, with the determined difference being taken into account in a further step in the dynamic regulation of the energy flow. The depth difference is in particular maintained above and/or below a lower or upper limit value by the active influencing of the power distribution.

It is particularly advantageous if the energy flow to the attachment is restricted if the casing depth is larger than the excavation depth by at least a limit amount. Conversely, it can be sensible to increase or even to maximize the energy flow to the attachment if the excavation depth is larger than the current casing depth by at least a limit amount. Such a relationship between the depth difference and the power distribution can be particularly advantageously mapped by a cost function, with this determining the average power proportion to be output to the attachment in dependence on the depth difference, for example.

As was already indicated above, the work processes of the attachment and/or of the base machine can be divided into cyclically occurring individual steps that also differ from one another with respect to the power requirement. It is particularly advantageous for the optimization of the power management to take account of the performance or future performance of the individual steps during a complete work cycle in the dynamic regulation of the energy flow. It is sensible here that the energy flow to the base machine is dynamically set on the basis of the average power proportion while further taking account of the cyclic excavation process of the base machine. This can optionally take place by multiplication of the average power value by a weighting parameter that characterizes the current individual step of a complete work cycle. It is specifically possible that such a weighting parameter is smaller during the digging and lifting of the excavation tool of the base machine than during the lowering and emptying of the excavation tool. The selection of the suitable weighting now provides that a smaller power proportion (for example, a weighting factor less than 1) is provided to the attachment during the digging and lifting of the base machine since the digging and lifting process of the base machine is comparatively energy-intensive. Conversely, the power requirement during the lowering and emptying of the excavation tool of the base machine is much lower; surplus energy can be provided to the attachment by the selection of a higher weighting factor, for example of approximately 1.

An optimum efficiency of the power transfer results on a specific position of the two oscillating cylinders due to the geometry of the design of a typical casing oscillator. The efficiency decreases on large deviations in both directions. The effective oscillation angle at the front of the casing reduces in particular with very large casing depths due to twisting of the casing. Against this background, it is sensible likewise to set this oscillating angle dynamically during the operation or as the casing depths increase. It has proved sensible here for the attachment to set the oscillation angle dynamically while taking account of the current power consumption of the attachment and/or in dependence on the casing depth or the excavation depth. The work process or the effectiveness of the casing oscillator can hereby be ideally set since an optimum, maximum oscillation angle can be set while taking account of the aforesaid values.

The soil strength at the current work location is of further significance. This factor can also be taken into account for the optimum setting of the attachment or of the base machine. A further pipe section can in particular be installed to improve the contact pressure with a poor driving of the casing oscillator. It is also conceivable that in such a case the casing oscillator specifically requests more energy for the casing procedure from the base machine over the communication interface. The casing oscillator can set the current advance speed, for example while taking account of the depth change of the casing over time.

In addition to the method in accordance with the invention, the present invention also relates to a system comprising a base machine, in particular a cable excavator or drilling rig, and at least one attachment, optionally a casing oscillator or a casing rotator. The attachment and the base machine comprise at least one control for carrying out the method in accordance with the invention. The control of the method is in particular taken over by a control of the base machine. The system is accordingly characterized by the same advantages and properties such as have already been explained in detail above with reference to the method in accordance with the invention. A repetitive description is dispensed with for this reason.

BRIEF DESCRIPTION OF THE DRAWINGS

Further advantages and properties of the invention will be explained in the following in more detail with reference to an embodiment shown in the Figures. There are shown.

DETAILED DESCRIPTION

The preparation of piles by means of a casing oscillator in combination with a cable excavator (drilling with a hammer grab) or with a drilling rig (Kelly drilling) should be optimized by an assistant with respect to energy (fuel consumption) and the required time. The assistant here dynamically regulates the distribution of the energy between the casing oscillator and the base machine to optimize the capacity and the effectiveness of the two machines.

Figure 1:
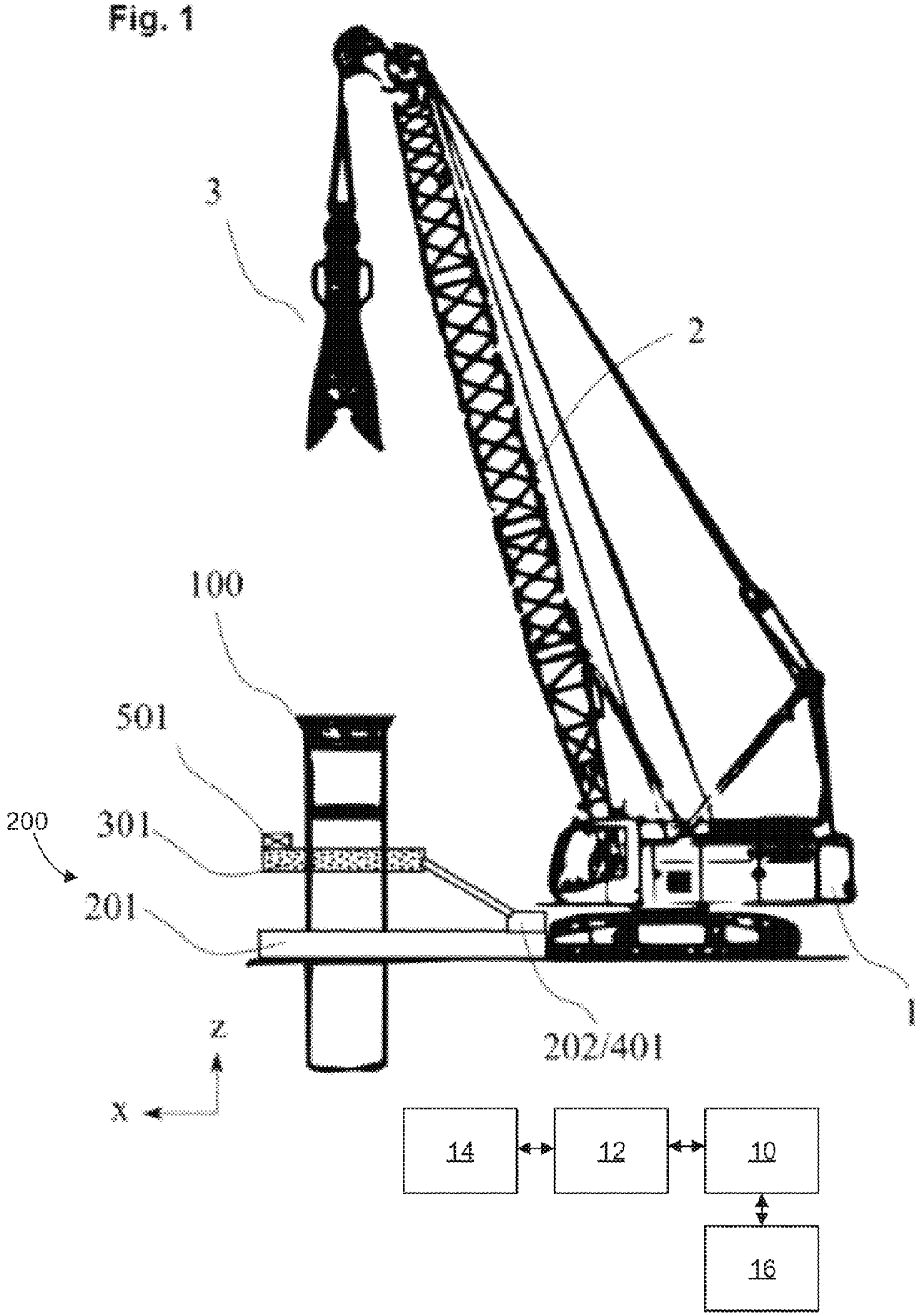
FIG. 1 shows a side view of the system in accordance with the invention comprising a base machine and a casing oscillator.

During drilling with a hammer grab using a casing oscillator, two units that are independent per se, that is a cable excavator 1 and the attachment 200 of the cable excavator 1 in the form of the casing oscillator, work together to prepare a pile. It should be appreciated that as the casing oscillator 200 is attached to the cable excavator 1, the casing oscillator 200 may also be referred to herein as an attachment 200. As is shown by way of example in FIG. 1, the cable excavator 1 comprising a slewable superstructure, a boom 2, and a grab 3 takes over the excavation of a hole. A casing oscillator 200 comprising a base plate 201 and a table 301 adjustable in distance with respect to the base plate 201 is attached to the cable excavator 1. A casing 100 can be driven into the ground by this casing oscillator 200 as follows: the table 301 is, for example, latched to the casing 100 with the aid of a clamping cylinder. The base plate 201 is subsequently raised, whereby the weight force of the casing 100, of the table 301, and of the base plate 201 acts downwardly. To overcome the sticking friction, the table 301 is set into motion in a further step, for example into horizontal oscillations (so-called casing oscillators) or also into continuous rotation (so-called casing rotators). The casing 100 is lowered into the ground by this interplay while the cable excavator 1 excavates the soil within the casing 100.

Figure 2A:
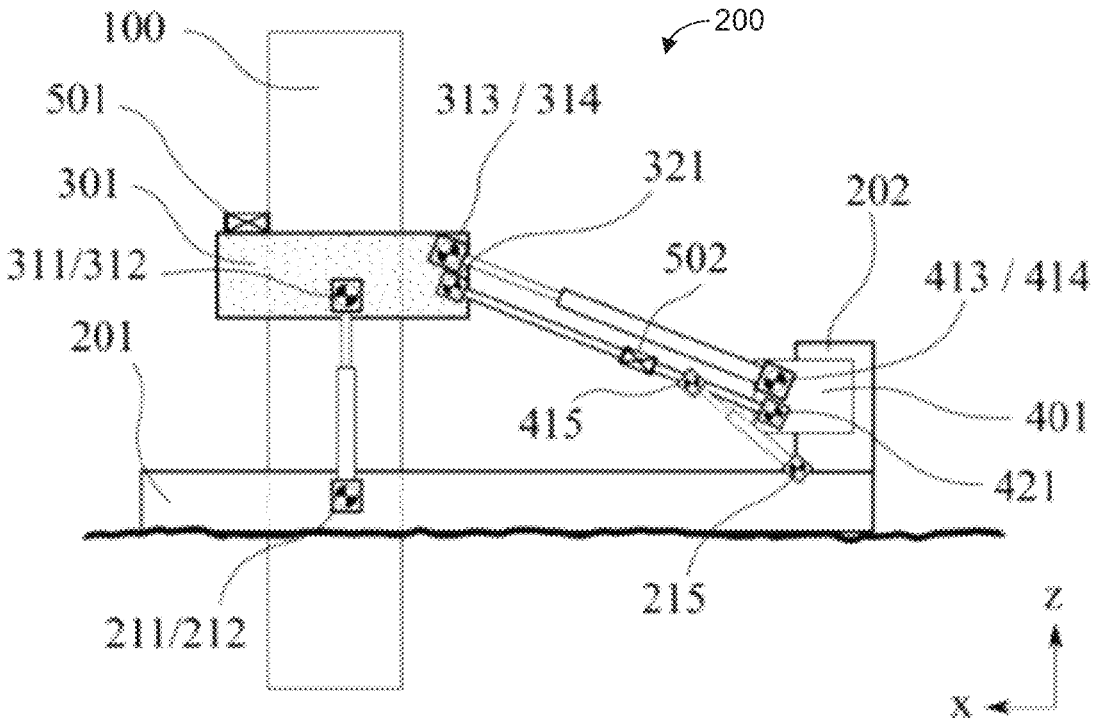
FIGS. 2A and 2B show a side view and a plan view of the casing oscillator.
Figure 2B:
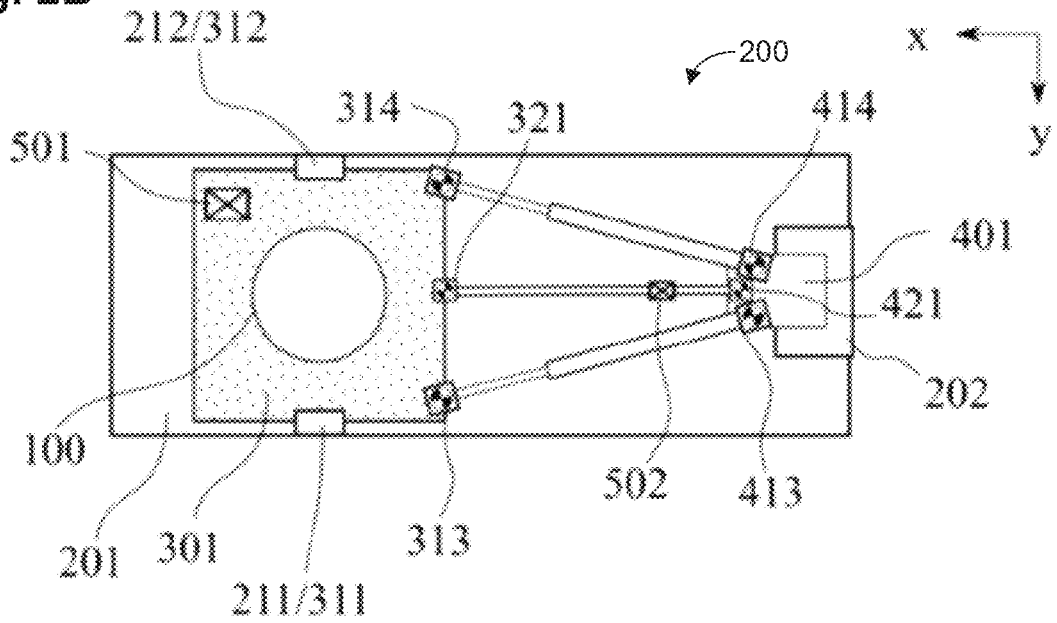

The casing oscillator 200 is shown with more details in FIGS. 2A, 2B that show the casing oscillator 200 with the casing 100 in a side view and in a plan view. The table 301 can, for example, be clamped to the pipe 100 by means of clamps. The base plate 201 can be raised between the connection points 211/311 and 212/312 by lifting cylinders. The table 301 can carry out rotational movements with respect to the base plate 201 by synchronized movements of the two oscillator cylinders between the connection points 313/413 and 314/414. A rigid steering rod is installed in articulated fashion at the point 321 at the table 301, on the one hand, and is installed in articulated fashion at the point 421 at the element 401, on the other hand. The inclination of the casing 100 about the y axis can be set by a movement of a steering cylinder that is installed in articulated fashion at the steering rod at the point 415, on the one hand, and that is installed in articulated fashion at the base plate 201 at the point 215, on the other hand; the inclination of the casing 100 about the x axis can be set by different lifting heights of the two lifting cylinders. The centers of rotation 413, 414, and 421 can be displaced by means of a guide 401 horizontally with respect to the structure 202 fixedly connected to the table 201. The inclination of the table 301 can be detected by means of the inclinometer 501, in particular to be able to align it for the desired pile inclination. The inclination or angle transmitter 502 detects the position of the steering rod, in particular for the determination of the casing depth.

The energy expenditure for the preparation of a pile is composed of the required power of the base machine 1 (cable excavator, drilling rig) for the excavation of the borehole and the required power of the casing oscillator 200 for introducing the casing 100. The casing 100 is rotated inwardly by the casing oscillator 200 by means of the weight force of the casing 100 and of the casing oscillator 200 in conjunction with a rotational movement. The inward rotation procedure of the casing oscillator 200 is very energy-intensive due to jacket friction and tip friction. The tip friction is co-determined by the properties of the ground and of the design of the casing 100. The jacket friction is produced by the relative movement of the casing 100 toward the ground along the outer surfaces of the casing 100. The jacket friction has two components, first the friction at the outer side of the casing 100 and second the friction at the inner side of the casing 100. The friction at the outer side becomes greater as the drilling progresses due to the contact area between the casing 100 and the ground increasing as the depth increases. The friction at the inner side of the casing 100 can, however, so-to-say be eliminated in that the lead of the casing 100 over the progress of the excavation is kept small.

The drilled material is removed from the casing 100 with the aid of the cable excavator 1 (drilling with a hammer grab) or of a drilling rig. The easily greatest power requirement of the cable excavator 1 or of the drilling rig occurs on the raising of the drilling tool 3. This energy effort, and also time effort, increases with the depth of the borehole due to the increasing size of the lifting height.

The power requirement can be optimized in that the energy flow between the base machine and the attachment (e.g., casing oscillator) is dynamically regulated. The regulation can here be controlled by the base machine (e.g., cable excavator 1), for example by the control 10 of the base machine. It is possible there that the base machine completely stops, maximizes, or also continuously regulates the energy flow. Alternatively to this, the base machine can request a change of the power requirement of the attachment (e.g., casing oscillator 200) over a communication interface 12 or can, for example, specify that certain worksteps may not be carried out or may not be recommended (particularly to be recommended in operation of the attachment with an additional power pack energy source).

An optimization of the process results with respect to the following cases. In the case of a high energy requirement, the base machine recognizes when, for example, a lot of energy has to be expended for the lifting of the drilling tool 3 and of the drilled material and reduces the energy flow to the attachment or stops the energy flow for the required time period (complete elimination of losses in the attachment).

In the case of a low energy requirement, the base machine recognizes when the energy capacity for the work to be carried out by the base machine is small and increases the energy flow to the attachment or starts the attachment for the maximum possible time period.

In the case of uneven progress, a possible specification due to local circumstances can be that, for instance, the casing 100 is always a minimum amount prior to the excavation of the borehole. If, for example, the excavation is in advance of the casing 100, it is possible that, for instance, the casing 100 crashes and thus causes damage and costs. If, however, the casing 100 is too far in advance, the jacket friction at the inner side becomes too large. The progress should accordingly take place at approximately the same speed with a predefined difference.

If the base machine 1 recognizes that the progress of the casing 100 is too large with respect to the excavation, the energy flow to the attachment 200 is reduced or stopped until the progress of the excavation comes back into the "range" of the casing 100. As a consequence, more power is available to the base machine 100 for this time period, whereby the excavation takes place faster. Furthermore, the total power requirement for the inward rotation of the casing 100 is reduced since there is a reduction in the jacket friction due to a reduction of the smaller lead of the casing 100.

In the case of an unfavorable oscillation angle, an optimum efficiency of the power transfer results at a specific position of the two oscillating cylinders due to the geometry of a typical casing oscillator. The efficiency decreases on large deviations in both directions.

The casing 100 comes to a stop on a change of the direction of rotation. The two oscillating cylinders now have to overcome the sticking friction; only then does the smaller dynamic friction come into play again.

A further effect that plays a role here: at very large depths, the effective oscillation angle is reduced at the front of the casing 100 due to twisting of the casing 100. There is therefore a kind of optimum, maximum oscillating angle that depends on the depth of the casing 100 due to these three constraints. To therefore optimize the process, an optimum, maximum oscillating angle can be set by a measurement of the depths of the casing and of the excavation and by an additional measurement of the power consumption of the casing oscillator 200.

In the case of high soil strength, the casing oscillator 200 can request a further pipe section to improve the contact pressure or can request the provision of more energy from the base machine with a poor driving of the casing oscillator.

For the optimization with uneven progress, a depth measurement of the casing and depth measurement of the excavation may be measured. For the optimization of the oscillation angle, measurement of the oscillation angle (angle of rotation sensor in one of the joints of the steering rod or, less ideally, in one of the joints of the oscillating cylinders) may be measured.

Advantages of the present disclosure include more energy for the work to be prioritized (time optimization), less consumption due to time gained (keyword base load/losses), and fewer operating hours due to time gained.

Application examples are described further herein. The placing of a further pipe section onto the casing 100 by the base machine 1 is a laborious process in which the base machine 1, however, requires very little energy. The grab 3 is put to one side, a pipe section 100 is fastened to the cable, is placed onto the existing casing, and is then latched to the remaining casing. A very large amount of energy is specifically available to the casing oscillator during the first part of this process. The following examples can now be derived therefrom.

The casing oscillator 200 has measured that a casing 100 is a specific number of meters under the ground. The depth of the excavation is also known by the cable length measurement of the cable excavator 1 and the remaining height of the casing above the casing oscillator can be concluded from a comparison of the cable length with the upper pipe edge. The casing 100 is now, for example, 20 meters under the ground, the excavation 19 meters; 4 meters of pipe are still available for inward rotation. Due to the local circumstances the casing 100 must be at least one meter in advance of the excavation. The process of the inward rotation by the casing oscillator 200 should now correspondingly become faster, whereas the excavation process of the cable excavator 1 can take place more slowly. To now use the time efficiently, the two machine controls agree that the cable excavator 1 places a further pipe on or suggests this to the operator. In this case, the cable excavator 1 requires little energy; the casing oscillator 200 can advance faster due to the energy that has been released. As an additional positive effect, the weight of the casing 100 is increased by the additional part section and the driving in is also hereby accelerated.

The base machine requires a very large amount of energy during the lifting of the excavation tool 3, the oscillation of the casing oscillator 200 likewise requires a lot of energy. A further application example can be derived from this:

The cable excavator 1 travels with the tool 3 into the casing 100 and digs itself free of material at the bottom. The cable excavator 1 next has to raise the tool 3 filled with excavated material. This circumstance can already be communicated to the casing oscillator 200 in advance, for example by the control 10 of the cable excavator 1 via a communication interface 12. As soon as the cable excavator 1 lifts the tool 3, the energy supply to the casing oscillator 200 can be reduced. The casing oscillator 200 uses this time for the energetically more favorable work such as the lifting of the base plate 201. As soon as the tool 3 has reached the upper pipe edge, the cable excavator 1 reports to the casing oscillator 200 that the lifting is complete and accordingly increases the energy flow to the casing oscillator 200, whereby it can now rotate the clamped casing at full energy.

With an unfavorable distribution of the depths (if, for instance, the casing oscillator 200 is a lot deeper than the excavation and correspondingly the jacket friction at the inner side of the casing 100 is very high), the energy supply to the casing oscillator 200 can be completely stopped in the extreme case for the duration of the excavation.

The time that is required for the lifting of the excavation tool 3 increases steadily with the depth. An increased time effort results from this for the removal of a specific amount of drilled material at large depths. As a result, the work of the base machine 1 advances more slowly at large depths. The time the casing oscillator 200 needs for the introduction per meter of casing 100, however, does not increase to the same degree with the depth. It can be derived from this:

The cable excavator 1 only progresses slowly with the excavation as the depth increases. The lead of the casing 100 thereby increases continuously. Due to this the cable excavator 1 can restrict the energy supply to the casing oscillator 200 to have more energy available for its own work.

Figure 4A:
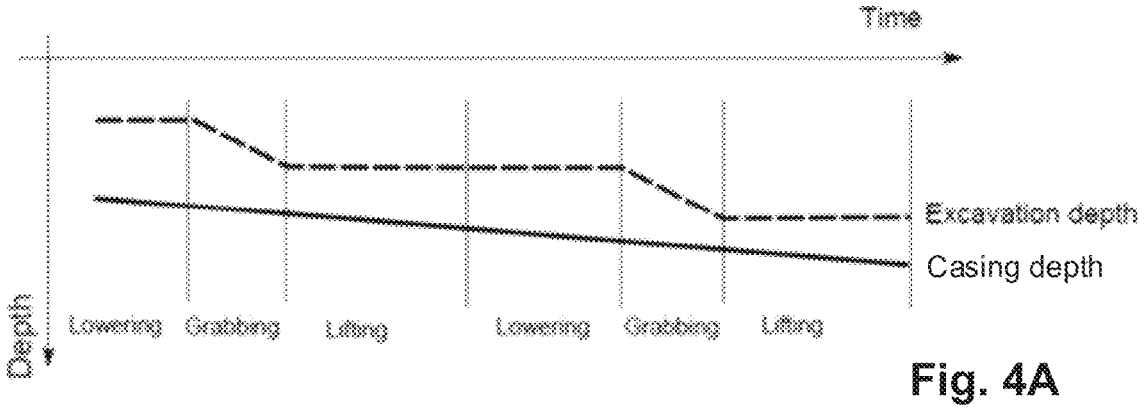
FIGS. 4A and 4B show two diagram representations of the excavation depth and casing depth over time.
Figure 4B:
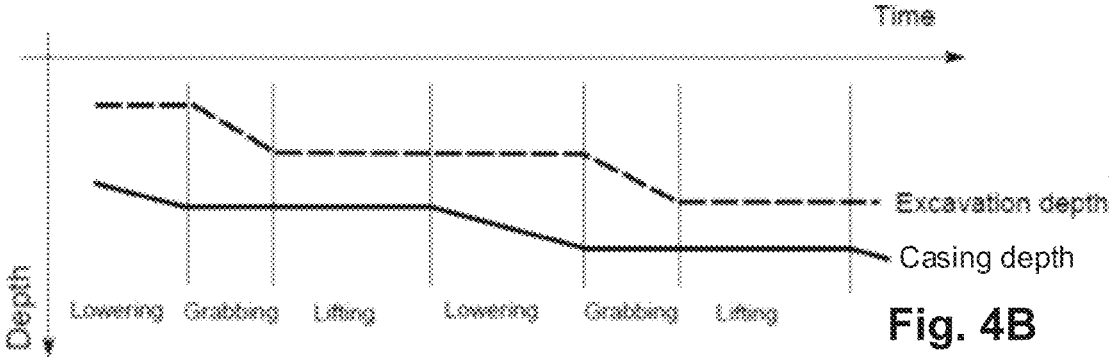

With an unfavorable distribution of the depths (if, for instance, the casing oscillator 200 is a lot deeper than the excavation and the jacket friction at the inner side of the casing is correspondingly very high), the energy supply to the casing oscillator 200 can be completely stopped at times in the extreme case (see example in FIG. 4B).

Two different methods are carried out in parallel: process optimization and optimization of the machine capacity. Regarding process optimization, the operator of the casing oscillator 200 sets a minimal depth difference $D_{min}$. On a simultaneous casing oscillation and excavation by means of the grab 3, the grab 3 may not fall below this minimal depth difference (e.g. $D_{min}$=40 cm, that is the casing 100 always has to be at least 40 cm in advance of the grab 3). There is no $D_{max}$, the casing 100 may be as far in advance of the grab 3 as desired.

Figure 3:
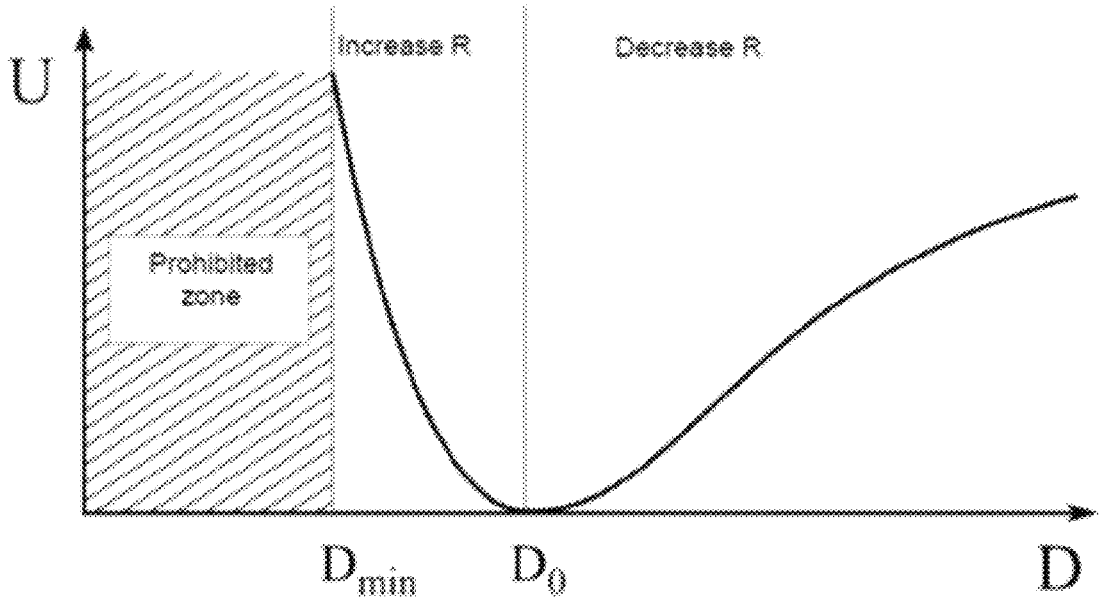
FIG. 3 shows a diagram representation to illustrate the cost function in dependence on the depth difference between the casing depth and the excavation depth.

A cost function U will now be formulated as a function of the depth difference D with a minimum $D_0 > D_{min}$. See FIG. 3 in this regard. The energy distribution R is ideal at $D_0$.

If D is now smaller than $D_0$, the power proportion R that the cable excavator 1 provides to the casing oscillator 200 increases. This has two effects: the casing oscillator 200 receivers more power, thus rotates faster, and thereby increases D; on the other hand, the cable excavator 1 has less power and thus reduces its excavation speed, which also has the result of an increase in D. If D should be smaller than $D_0$ and if the energy provided to casing oscillator 200 should already be at a maximum, the weight of the casing has to be increased to increase the contact pressure, for example by placing on a further partial pipe.

If D is greater than $D_0$, the power proportion R that the cable excavator 1 provides to the casing oscillator 200 reduces. The power proportion R is consequently calculated in accordance with the formula $R=P_{CasingOscillator}/P$, where $P_{CasingOscillator}$ is the proportion of the total power P that is provided to the casing oscillator 200 due to the process optimization.

If D approaches close to $D_{min}$, the casing oscillator 200 should be stopped.

Regarding the method for optimization of the machine capacity, how large the average proportion of the power is that the cable excavator 1 provides to the casing oscillator 200 is set by the above process optimization. In a further sequence, this parameter R is now multiplied by a further parameter $R_{cyc}$ that takes the cyclic excavation process of the cable excavator 1 into account. The power division results, for example, as $Q=R\times R_{cyc}$. $R_{cyc}$ is accordingly a correction factor or weighting factor of the power proportion of the casing oscillator 200 due to the capacity of the cable excavator 1 that is typically within the value interval between 0 and 1.

The cable excavator 1 requires the most power during the excavation and during the lifting. In this time, the cable excavator should receive a lot of power; the casing oscillator 200 receives a smaller power during this time period. $R_{cyc}$ is therefore <1 up to an extreme case of $R_{cyc}=0$ (casing oscillator 200 no longer receives any power).

The cable excavator 1 requires a small power during the emptying of the grab 3 and during the lowering of the grab 3 into the borehole. In this time, the casing oscillator 200 can receive a larger power proportion without slowing down the process, an $R_{cyc}\sim 1$ is therefore selected.

An energetically optimum state is present when the spacing between the lines of FIGS. 4A and 4B is minimal.

Thus, in accordance with the present disclosure, the control 10 of the base machine 1 dynamically regulates the distribution of the energy between the attachment 200 and the base machine 1 in order thereby to optimize the capacity and effectiveness of the two machines. It is primarily a question of hydraulic or pneumatic energy that is provided to the attachment by the base machine. The method is, however, not restricted to a specific type of energy and could equally be used for the energy management of electrical energy.

The regulation of the energy flow takes place while taking account of the current power requirement of the base machine 1 and/or of the attachment 200. The process routine is meaningfully known to the control 10 or the control 10 has knowledge of future worksteps of the base machine 1 or of the attachment 200. In cyclic processes, this knowledge can also be learnt from past cycles. If, for instance, one of the two consumers 1 or 200 is always stretched to its limits energetically in the same part of the cycle and if simultaneously the other consumer does not require the total energy, a dynamic adaptation can be learnt. A dynamic regulation of the energy flow can thereby take place on the basis of this information on subsequent worksteps. Specifically, the total energy expenditure for the preparation of the pile is composed of the power requirement of the base machine 1 for the excavation of the borehole and the power requirement of the attachment 200 for introducing the casing 100. The respective cyclic worksteps performed on the units are characterized by a variable power requirement. It is accordingly sensible to supply the attachment with less energy during the carrying out of worksteps with less energy expenditure to be able to instead utilize the surplus energy in the base machine 1. If instead a process with a high energy requirement takes place in the attachment and if the base machine 1 requires comparatively little power, it is sensible to maximize the energy flow to the attachment 200. Individual worksteps can thereby be directly carried out faster, which can optimize the total process time. The total energy requirement during the pile foundation process can also hereby be optimized since the unnecessary provision of surplus energy to the base machine 1 or to the attachment 200 is prevented or at least reduced.

It is conceivable for the dynamic regulation to limit the energy flow to the attachment 200 or to stop it completely under certain circumstances. A limitation can take place stepwise, for example. A continuous limitation is, however, also conceivable to enable an adjustment of the energy flow that is as fine as possible.

As disclosed herein, the control of the energy flow takes place by a control 10 of the base machine 1. It is, however, likewise conceivable to outsource the process performance to an external control in part, for example to a control 14 of the attachment 200. There is meaningfully a communication interface 12 between the base machine 1 and the attachment 200, or more specifically between the control 10 of the base machine 1 and the control 14 of the attachment 200, to be able to exchange information relevant to the process for the dynamic regulation of the energy flow between the machines.

There is likewise the possibility of exchanging a demand for a power reduction or a power increase between the machines over the communication interface 12. For example, the base machine 1 or the control 10 of the base machine 1 may request, via the communication interface 12, the attachment 200 to reduce its energy consumption to thereby ensure a higher power proportion for the base machine 1. Conversely, the attachment 200 or the control 14 of the attachment 200 could also request, via the communication interface 12, an increase of the energy flow to the attachment 200 from the base machine 1.

A corresponding request for a power reduction to the attachment 200 can also include an instruction on and a specification of worksteps of the attachment 200 to be carried out. For example, the request transmitted to the control 14 of the attachment 200 via the communication interface 12 from the control 10 of the base machine 1 may specify worksteps to be carried out by the attachment 200 or recommend one or more worksteps for the attachment 200. Such a recommendation is meaningfully based on the power requirement of the base machine 1. If the base machine 1 requires a comparatively large amount of power, the specification or recommendation includes energy-saving worksteps; conversely, the carrying out of high-energy worksteps is recommended or specified to the attachment 200 if surplus energy is currently available on the part of the base machine 1.

The process time of individual worksteps can be directly influenced or controlled by means of the dynamic regulation of the energy flow. This relates to worksteps both of the attachment 200 and of the base machine 1. The rotational movement of the attachment 200 can, for example, be specifically accelerated by the provision of additional energy. Conversely, a power reduction produces a delay or a slowing down of the respective worksteps.

It is of particular importance for the pile foundation and in particular for an optimum energy expenditure during the pile foundation that the casing process is synchronized with the simultaneous excavation of the borehole. If, for example, the excavation of the casing 100 takes place in advance, there is the risk of a crashing of the casing 100, which can cause material damage and costs. If, however, the casing 100 is too far in advance, the jacket friction on the inner side becomes too large, which can cause higher energy costs. The progress of both processes should accordingly be kept approximately the same or the casing depth should be slightly in advance of the excavation depth with a constant interval.

This relationship makes a monitoring of the different between the depth of the earth excavation and the casing depth sensible, with the determined difference being taken into account in a further step in the dynamic regulation of the energy flow. The depth difference is in particular maintained above and/or below a lower or upper limit value by the active influencing of the power distribution.

It is particularly advantageous if the energy flow to the attachment is restricted if the casing depth is larger than the excavation depth by at least a limit amount. Conversely, it can be sensible to increase or even to maximize the energy flow to the attachment if the excavation depth is larger than the current casing depth by at least a limit amount. Such a relationship between the depth difference and the power distribution can be particularly advantageously mapped by a cost function, with this determining the average power proportion to be output to the attachment in dependence on the depth difference, for example.

As was already indicated above, the work processes of the attachment 200 and/or of the base machine 1 can be divided into cyclically occurring individual steps that also differ from one another with respect to the power requirement. It is particularly advantageous for the optimization of the power management to take account of the performance or future performance of the individual steps during a complete work cycle in the dynamic regulation of the energy flow. It is sensible here that the energy flow to the base machine 1 is dynamically set on the basis of the average power proportion while further taking account of the cyclic excavation process of the base machine 1. This can optionally take place by multiplication of the average power value by a weighting parameter that characterizes the current individual step of a complete work cycle. It is specifically possible that such a weighting parameter is smaller during the digging and lifting of the excavation tool of the base machine 1 than during the lowering and emptying of the excavation tool. The selection of the suitable weighting now provides that a smaller power proportion (for example, a weighting factor less than one) is provided to the attachment 200 during the digging and lifting of the base machine 1 since the digging and lifting process of the base machine 1 is comparatively energy-intensive. Conversely, the power requirement during the lowering and emptying of the excavation tool of the base machine 1 is much lower; surplus energy can be provided to the attachment 200 by the selection of a higher weighting factor, for example of approximately one.

An optimum efficiency of the power transfer results on a specific position of the two oscillating cylinders due to the geometry of the design of the casing oscillator 200. The efficiency decreases on large deviations in both directions. The effective oscillation angle at the front of the casing 100 reduces in particular with very large casing depths due to twisting of the casing 100. Against this background, it is sensible likewise to set this oscillating angle dynamically during the operation or as the casing depths increase. It has proved sensible here for the attachment 200 to set the oscillation angle dynamically while taking account of the current power consumption of the attachment 200 and/or in dependence on the casing depth or the excavation depth. The work process or the effectiveness of the casing oscillator 200 can hereby be ideally set since an optimum, maximum oscillation angle can be set while taking account of the aforesaid values.

The soil strength at the current work location is of further significance. This factor can also be taken into account for the optimum setting of the attachment 200 or of the base machine 1. A further pipe section can in particular be installed to improve the contact pressure with a poor driving of the casing oscillator. It is also conceivable that in such a case the casing oscillator 200 specifically requests more energy for the casing procedure from the base machine 1 over the communication interface 12. The casing oscillator 200 can set the current advance speed, for example while taking account of the depth change of the casing 100 over time.

To perform the above steps for dynamically regulating the energy flow from the base machine 1 to the attachment 200, the control 10 of the base machine 1 may comprise a computing device configured with executable instructions in non-transitory memory of the control 10 that, when executed by a processor of the control 10, cause the control 10 to perform one or more actions such as described hereinabove. For example, the executable instructions when executed may cause the control 10 to control (i.e., actuate) one or more elements of the base machine 1, to determine power consumption of the base machine 1 and/or the attachment 200, to evaluate performance or future performance of the individual steps during a complete work cycle in the dynamic regulation of the energy flow, to generate and transmit requests and/or instructions to the attachment 200, and so on. Such a control 10 may be positioned at or integrated into the base machine 1.

Similarly, the control 14 of the attachment 200 may comprise a computing device configured with executable instructions in non-transitory memory of the control 14 that when executed by a processor of the control 14 cause the control 14 to perform one or more actions as described hereinabove. For example, such executable instructions may cause the control 14 of the attachment 200 to control (i.e., actuate) one or more elements of the attachment 200, perform one or more worksteps as instructed or recommended by the control 10 of the base machine 1, and so on as described hereinabove. In some examples, the control 14 may be positioned at or integrated within the attachment 200. As mentioned above, the control 10 of the base machine 1 and the control 14 of the attachment 200 may be communicatively coupled via the communication interface 12, which may comprise a wired or wireless communication network for coupling the controls 10 and 14.

Further, in some examples, one or more sensors 16 may be communicatively coupled to the control 10 and/or the control 14. The one or more sensors 16 may include one or more depth sensors for measuring the casing depth and/or the excavation depth. The control 10 and/or the control 14 may thus receive signals from the one or more sensors 16 indicating the casing depth and/or the excavation depth. The control 10 may, in some examples, measure a depth difference between a depth of earth excavation and a casing depth from such signals received from the one or more sensors 16. The control 10 may control the attachment 200 to hold the depth difference above and/or below a lower and/or higher limit value by the dynamic regulation of the energy flow.

The invention claimed is:

1. A method of power management during preparation of a pile having a base machine for excavating a borehole and an attachment installed at the base machine for a simultaneous introduction of a casing into a ground, wherein an energy supply for the attachment is at least partially provided by the base machine, the method comprising:

stepwise or continuously regulating, with a control of the base machine, energy flow from the base machine to the attachment including increasing energy supply to the attachment and decreasing energy supply to the base machine when a required excavation energy is low.

2. The method of claim 1, wherein regulating the energy flow comprises regulating the energy flow according to a current power requirement of the base machine and/or of the attachment.

3. The method of claim 1, further comprising limiting or completely stopping the energy flow to the attachment, wherein the limiting of the energy flow is stepwise or continuous.

4. The method of claim 1, further comprising communicating, with the control of the base machine, a request for a power reduction to the attachment over a communication interface.

5. The method of claim 4, wherein the request includes an instruction on worksteps of the attachment to be carried out.

6. The method of claim 5, wherein the instruction includes a specification and/or recommendation with respect to worksteps to be carried out and/or not to be carried out.

7. The method of claim 1, further comprising actively controlling a process time for worksteps of the attachment and/or of the base machine by means of the regulation of the energy flow.

8. The method of claim 1, wherein a depth difference between a depth of earth excavation and a casing depth is taken into account for the regulation, with the depth difference optionally being held above and/or below a lower and/or higher limit value by the regulation of the energy flow.

9. The method of claim 1, further comprising detecting, with the attachment, an advance speed of the casing.

10. The method of claim 9, further comprising detecting the advance speed of the casing while taking account of the depth change of the casing over time, and requesting, based on the advance speed, an increase of the energy flow from the base machine to the attachment over a communication interface and/or initiating a work process to place a further pipe onto the casing.

11. A method of power management during preparation of a pile having a base machine for excavating a borehole and an attachment installed at the base machine for a simultaneous introduction of a casing into a ground, wherein an energy supply for the attachment is at least partially provided by the base machine, the method comprising:

stepwise or continuously regulating, with a control of the base machine, energy flow from the base machine to the attachment;

wherein a depth difference between a depth of earth excavation and a casing depth is taken into account for the regulation, with the depth difference optionally being held above and/or below a lower and/or higher limit value by the regulation of the energy flow; and restricting the energy flow to the attachment if the casing depth is larger by at least a limit amount than an excavation depth, and/or further comprising increasing or maximizing the energy flow to the attachment if the excavation depth is larger by at least a limit amount than the casing depth.

12. The method of claim 11, wherein a cost function U is defined as a function of the depth difference that defines an average power proportion to be output to the attachment in dependence on the depth difference.

13. The method of claim 12, further comprising dynamically setting the energy flow to the attachment on a basis of the average power proportion while further taking account of a cyclic excavation process of the base machine.

14. The method of claim 13, wherein dynamically setting the energy flow to the attachment on the basis of the average power proportion while further taking account of the cyclic excavation process of the base machine comprises multiplying an average power value by a weighting parameter that characterizes a current process step during the cyclic excavation process.

15. The method of claim 14, wherein the weighting parameter is smaller during digging and lifting of an excavation tool and is larger during lowering and emptying of the excavation tool.

16. The method of claim 11, wherein the attachment sets an oscillation angle of the attachment configured as a casing oscillator while taking account of a current power consumption of the attachment and/or in dependence on the casing depth and/or in dependence on the excavation depth.

17. A system, comprising:

a base machine including an excavating assembly for excavating a borehole, at least one attachment installed at the base machine independent from the excavating assembly for introduction of a casing into a ground simultaneously with the excavating assembly, wherein an energy supply for the at least one attachment is at least partially provided by the base machine; and at least one control for stepwise or continuously regulating energy flow from the base machine to the at least one attachment.

18. The system of claim 17, wherein the base machine comprises a cable excavator or a drilling rig.

19. The system of claim 17, wherein the at least one attachment comprises a casing oscillator or a casing rotator.

20. The system of claim 17, wherein the at least one control stepwise or continuously regulates the energy flow according to a current power requirement of the base machine and/or of the at least one attachment.

* * * * *